United States Patent [19]

Auxer

[11] 3,964,290

[45] June 22, 1976

[54] INTERNAL PIPE BENDING MANDREL

[76] Inventor: Marvin L. Auxer, P.O. Box 1551, Houston, Tex. 77001

[22] Filed: Dec. 20, 1974

[21] Appl. No.: 534,822

[52] U.S. Cl. ..... 72/466
[51] Int. Cl.[2] ..... B21D 9/00
[58] Field of Search ..... 72/369, 392, 466

[56] References Cited

UNITED STATES PATENTS

| | | | |
|---|---|---|---|
| 3,274,817 | 9/1966 | Anderson | 72/466 |
| 3,747,394 | 7/1973 | Cunningham | 72/466 |
| 3,851,519 | 12/1974 | Calvin et al. | 72/466 |

*Primary Examiner*—Lowell A. Larson

[57] ABSTRACT

Internal pipe bending mandrel, which is expanded to fit tightly within the pipe and to support the pipe walls by plural sets of lever actuated jack means at opposite sides of the apparatus. The plural sets of jack means are spaced along the length of the apparatus, and are actuated simultaneously.

30 Claims, 7 Drawing Figures

INTERNAL PIPE BENDING MANDREL

BACKGROUND AND SUMMARY OF THE INVENTION

When pipe is bent, in order that it will remain of uniform circular cross section over the length of the bend, it is necessary to support the pipe wall at the interior of the pipe. If pipe is bent without being internally supported, the pipe wall at the outside of the bend will not stretch as it should, and the pipe crimps at the inside of the bend. In addition, the pipe becomes noncircular, of flattened oval shape. A number of internal pipe bending mandrels are provided by the art, but none of these are completely satisfactory in use.

According to the invention, an internal pipe bending mandrel is provided which fully supports the pipe in the plane of the bend, so that the pipe will remain uniformly circular over the entire length of the bend. A plurality of jack assemblies are provided spaced along the length of the apparatus. Each jack assembly includes plural jack devices and the jacking action is uniform transverse to the plane of the bend. When the apparatus is used, all of the jack devices operate simultaneously and uniformly to provide uniform support of the pipe walls. The action of the mandrel is sufficiently strong that the pipe may be made to be of slightly oblong shape along the plane of the bend if such is desired.

A principal object of the invention is to provide a satisfactory internal pipe bending mandrel. Another object of the invention is to provide such a mandrel which is relatively simple, easily repaired, easily maintained, and which is durable in use. A still further object of the invention is to provide such a mandrel which provides uniform support of the pipe walls during bending. A further object of the invention is to provide a pipe bending mandrel which is relatively economical in manufacture and use, and which is entirely reliable.

Other objects and advantages of the apparatus afforded by the invention will appear from the following detailed description of a preferred embodiment, and from the accompanying drawings, to which reference will be made during the description.

DESCRIPTION OF THE PREFERRED EMBODIMENT

Figure 1:
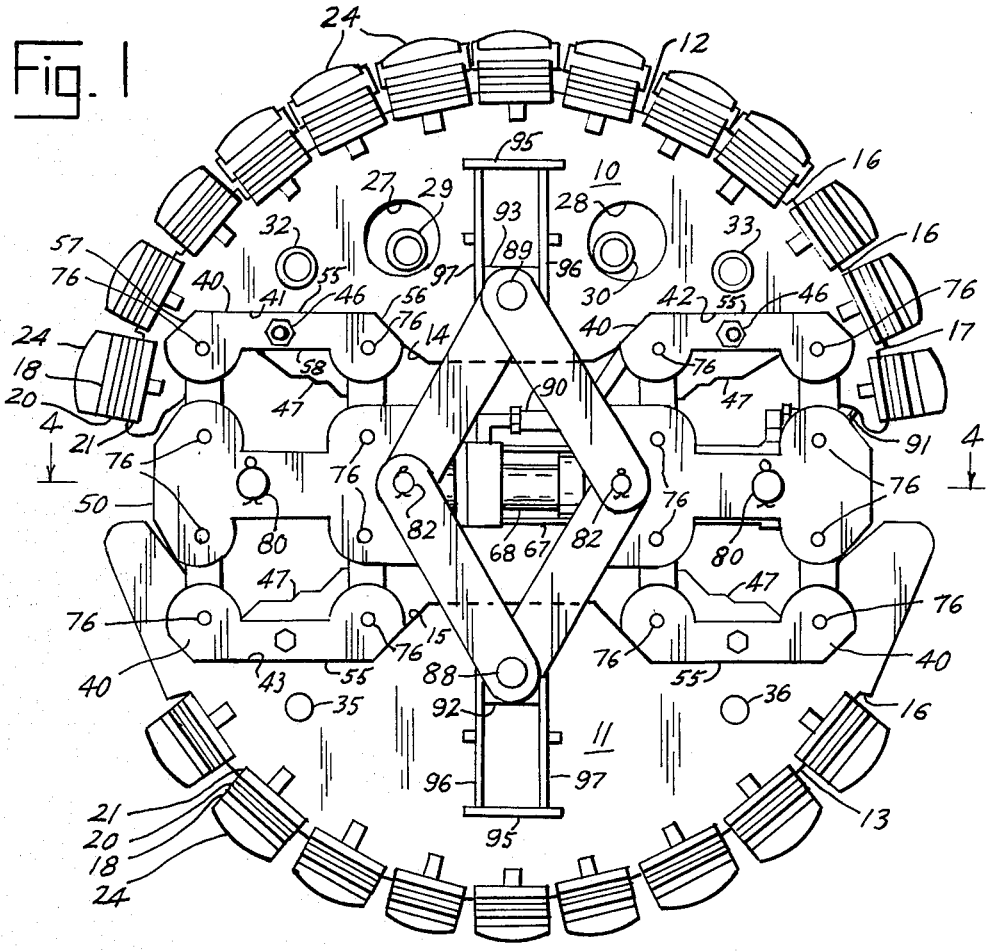
FIG. 1 is an end elevation of the preferred embodiment of the apparatus according to the invention.

Referring now to the drawings in detail, a preferred embodiment of internal pipe bending mandrel according to the invention will now be described. Referring first to FIG. 1 of the drawings, which shows an end elevation of the apparatus, the shaped plates 10, 11 have approximately arcuate peripheries 12, 13 and shaped inner sides 14, 15, respectively. Plates 10, 11 are relatively thick and heavy in order to be able to withstand the pipe wall supporting loads imposed thereon. The peripheries and inner sides of plates 10, 11 are symmetrical with respect to their vertical centers. Periphery 12 of plate 10 is stepped, as at 16 and 17.

Figure 5:
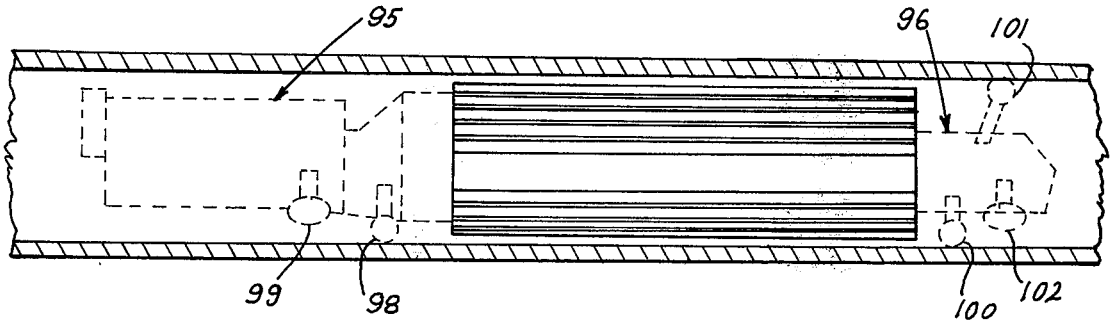
FIG. 5 is a schematic drawing indicating the manner of use of the apparatus.

Elongate bars 18, 19 and plural spacers 20 are affixed to longitudinally extending end plates 21 of the plates 10, 11 at each end of the apparatus. Referring also to FIG. 5, the bars 18, 19 have affixed thereto along their lengths pads 24 of plastic or resin material, these being of the same or of different thicknesses as shown, to provide the outer pipe engaging periphery of the apparatus as required. The number and thickness of the spacers 20 may be varied.

Between the end plates 10, 11 at each end of the apparatus are disposed a plurality of similar plates 10*a*, 11*a*, which are substantially the same as plates 10, 11 except that the end plates 21 are not present on plates 10*a*, 11*a*.

Plates 10 and 10*a* have openings 27, 28 therethrough through which are disposed hydraulic fluid supply conduits 29, 30. Plate 10 and 10*a* also have circular openings through which pipes 32, 33 are closely but slidably disposed. Pipes 32, 33 keep all of the plates 10 and 10*a* in alignment. Plate 11 has openings through which are disposed bars 35, 36, the bars being fixed in place in the openings.

Figure 3:
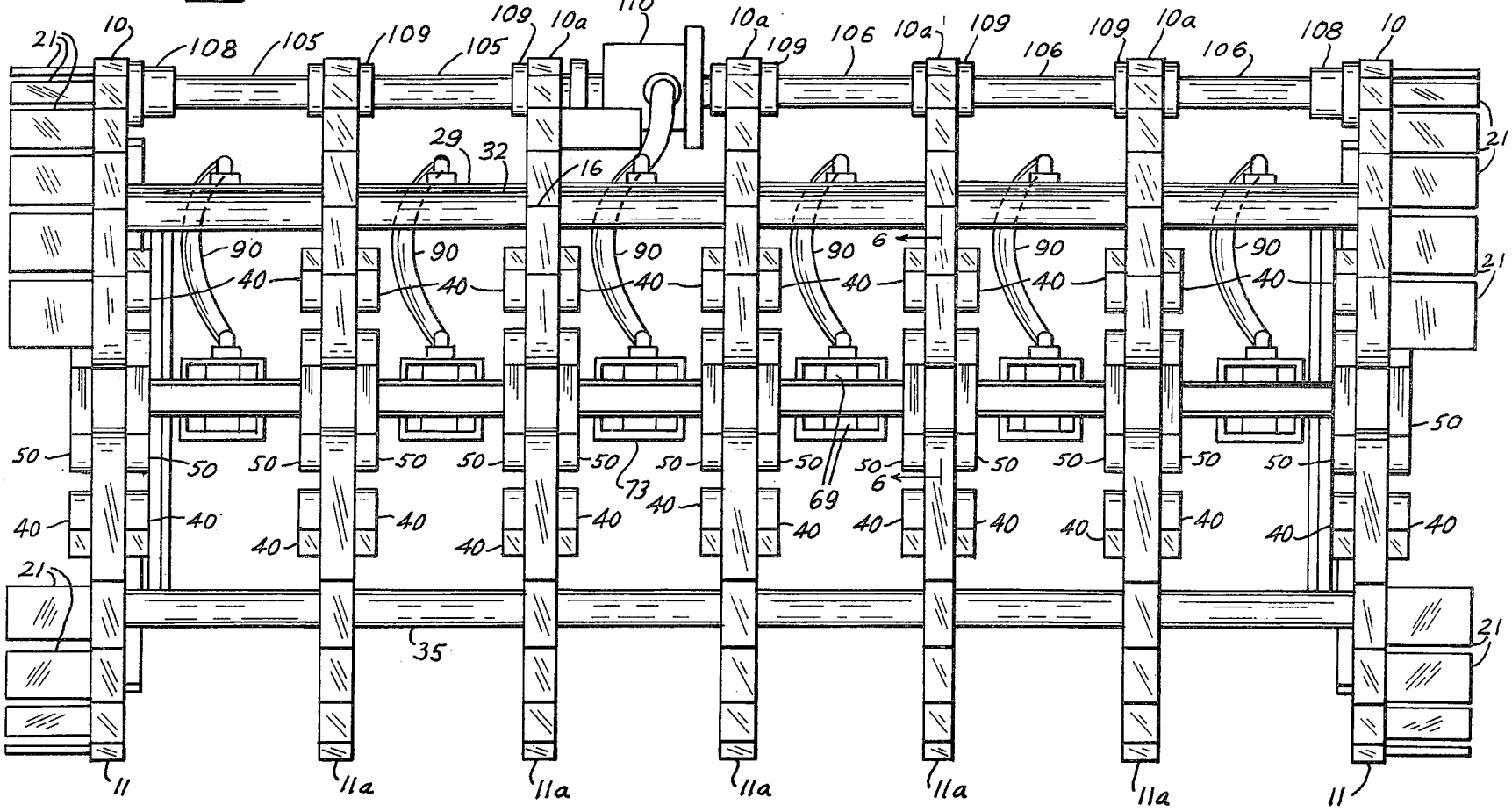
FIG. 3 is a side elevation of the apparatus of FIG. 1, certain elements being omitted.

The apparatus as shown in the drawings has two sets of end plates 10, 11 and five sets of intermediate plates 10*a*, 11*a*, spaced equidistances apart as is best seen in FIG. 3. The pipes 32, 33 and rods 35, 36 maintain the plates in properly spaced alignment. Other numbers of sets of intermediate plates 10*a*, 11*a* may be used.

At each side of each pair of plates 10, 11 and 10*a*, 11*a* there are disposed four base elements 40. The elements fit partially into the correspondingly shaped underside pockets 41, 42 of plates 10, 10*a* and into the upperside pockets 43, 44 of plates 11, 11*a*. The elements 40 opposite each other across the plates 10, 11 and 10*a*, 11*a* are bolted together by bolts 46 which extend through spacer plates 47.

Figure 6:
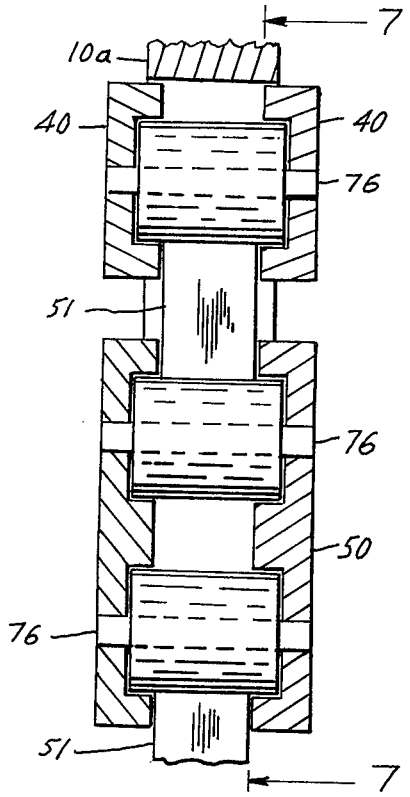
FIGS. 6–7 are partial vertical cross sections taken at line 6—6 of FIG. 1 and at line 7—7 of FIG. 3.
Figure 7:
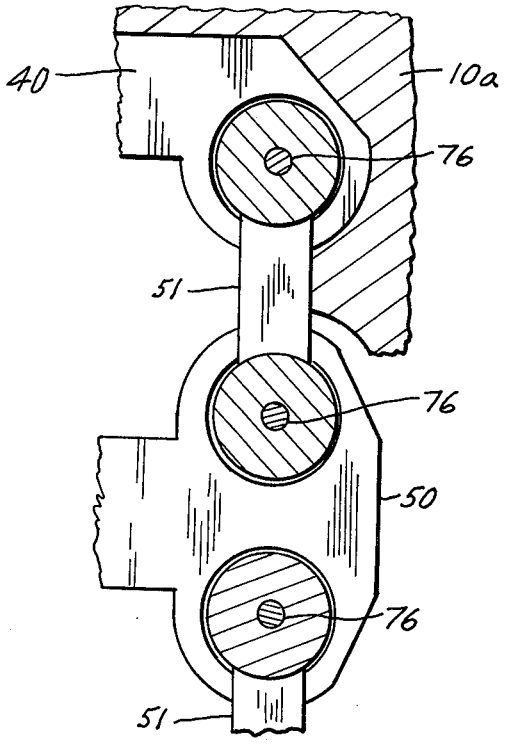

Elements 40 are linked to movable connection members 50 by the plural knuckle members 51. The knuckle members are shaped as indicated in FIGS. 6 and 7 having cylindrical ends 52 which are received in correspondingly shaped recesses 53 at the backs of elements 40. The elements 40 themselves partially fit within the pocket spaces 41, so that the load bearing capabilities of the assembly are high.

There are four elements 40 at each side of the plates 10, 11 and 10*a*, 11*a*, and there are two connection members 50 at each side of the plates 10, 11. Elements 40 have flat sides at 55 and angular end surfaces 56, 57. The elements 40 are cylindrically shaped at their ends with a rectangular connection 58 therebetween.

The members 50 have four cylindrical pivot connection portions 59, 60, arranged rectangularly, and a narrowed central bar portion 62.

Figure 4:
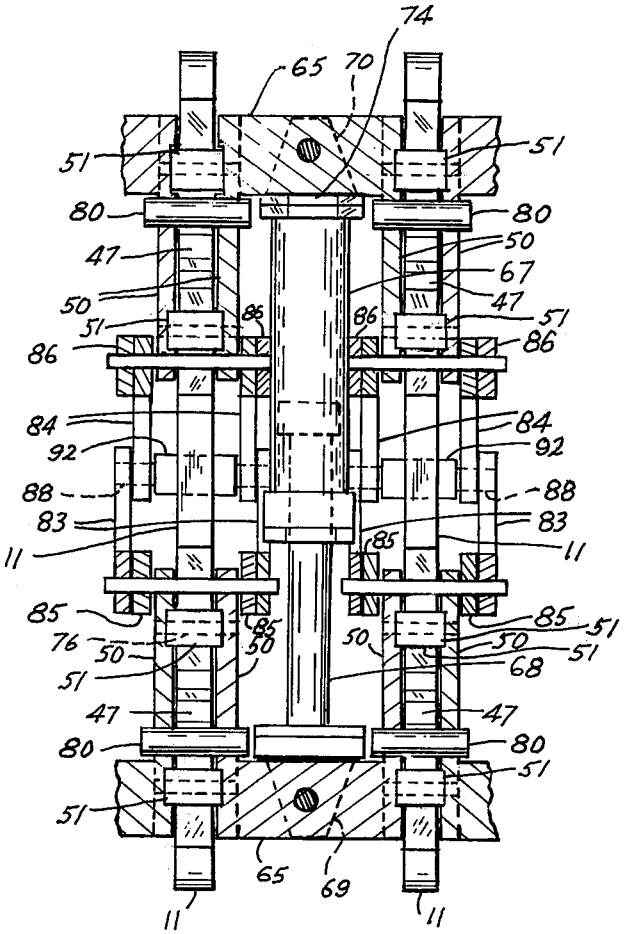
FIG. 4 is a partial top elevation of the apparatus of FIG. 1.

As will be made more clear by reference to FIGS. 3 and 4, the elements 40 at the ends of the apparatus are single elements. The elements 40 between the terminal elements 40 are paired and integrally connected together by cross members 65. The elements 65 opposite each other across the width of the apparatus are connected by a hydraulic cylinder 67 having shaft 68. Yoke brackets 69, 70 respectfully connected the shaft and cylinder ends to the members 65. Each shaft 68 has an end plate 72 which is bolted (bolts not shown) to the bracket plate 73. The end of each cylinder 67 is similarly bolted to a bracket plate 74 of the bracket 70.

The elements 40 at opposite sides of the plates are held pivotally assembled to knuckle members 51 by pins or bolts 76. The opposite ends of the knuckle members 51 are secured to members 50 by pins or bolts 77. Cylindrical bars 80 hold members 50 at opposite sides of the plates in alignment.

The inner ends of members 40 are connected by pins 82 to pivotal link bars 83–86. The bars 82 extend through holes through the ends of these members, linking them as shown. Pins 88, 89 connect link bars 83, 84 and 85, 86 respectively to bars 92, 93, bars 92, 93 being of rectilinear cross section. These bars ride in rectangular slots formed by plates 95, 96, 97 which line rectangular openings through the plates 10 and 11. The links 83–86 connected in this manner insure that the jack elements at both sides of the plates and at both sides of the apparatus transverse to the planes of the plates will perform simultaneously in identical manner, so that the jacking action will be uniform. The link bars 83–86 and bars 92, 93, are interrelated elements, may be omitted from the assemblies of some of the sets of plates 10, 11 and 10*a*, 11*a*, as the interconnections between the sets will cause the desired simultaneous jacking action. For example, if there are five sets of plates, only the second and fourth sets may be provided with the desired linkages.

Figure 2:
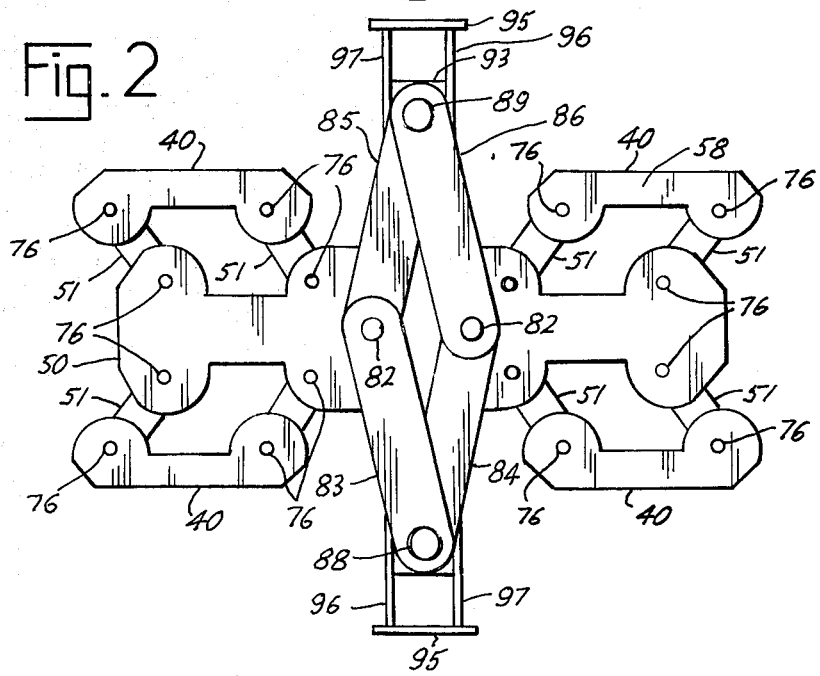
FIG. 2 is a partial end elevation of the apparatus shown in FIG. 1, showing only certain elements of the apparatus in moved positions.

Referring particularly to FIGS. 1 and 2 of the drawings, the apparatus as shown in FIG. 1 is in expanded condition, that is, the apparatus is shown in the condition as when it is tightly clamped within a pipe. The hydraulic cylinder 67 is in extended condition. The retracted condition of the apparatus is indicated in FIG. 2, only the jacking mechanisms being shown. In FIG. 2, the link bars 83–86 are shown moved pivotally closer together by retraction of the hydraulic cylinder 67. Pivot bars 82 are closer together in FIG. 2 than they are in FIG. 1, and the knuckle members 51 are in angular dispositions, members 50 being in inwardly moved positions. This movement of the knuckle members and jack members reduces the vertical spread of the upper and lower elements 40, so that the plates 10, 11 are moved closer together.

The apparatus is run to the position in a pipe where a bend is to be made while in the condition indicated by FIG. 2. After the apparatus is properly positioned, and before the bend is made, the hydraulic cylinders 67 are actuated to move the members 50 of each jack assembly farther apart. This expands the jack assemblies vertically, to move elements 40 farther apart, consequently also moving the plates 10, 11 of each set farther apart and urging the pads 24 against the pipe interior. Since all of the hydraulic cylinders 67 are subjected to the same pressure, all of the plates sets 10, 11 operate at the same force against the pipe wall, so that the jacking action from end to end of the apparatus is the same.

The hydraulic connections at the ends of the cylinders 67 are connected by flexible conduits 90, 91 to the hydraulic fluid supply conduits 29, 30. The flow of hydraulic fluid may be controlled from any convenient point.

Referring now to FIG. 5, the apparatus is supported in more or less conventional manner by a power unit 95 and a wheel support unit 96 connected respectively to opposite ends of the apparatus. Power unit 95 will have, in conventional manner, a hydraulic fluid tank or tanks, pumps, controls, valves and the like, for providing power for moving the apparatus along the pipe and for supplying the hydraulic fluid pressure necessary for actuation of the apparatus. Unit 95 will have driven wheel or wheels 98 and idler wheels 99 at opposite sides, the driven wheels being mounted such that they may be retracted during expansion of the apparatus. The wheel support unit 96 will have driven wheels 100, 101 and idler wheels 102, the driven wheels again being retractable.

As will now be clear, the invention affords an internal pipe bending mandrel which is capable of being expanded with great force within the pipe to support the pipe walls and prevent their distortion during pipe bending. The apparatus is flexible end to end, since the pipes or bars 32, 33 are slidably received in the holes through plates 10, 11, so that the apparatus as a whole may bend in the plane of the pipe bend. The plates 10 may move closer together or farther apart as necessary for this action. The longitudinal alignment of the apparatus is controlled through a hydraulic ram system which has not yet been described. Bars 105, 106 are connected to end plates 10 by fittings 108. The bars pass slidably through sleeves 109 disposed through plates 10a. A hydraulic cylinder 110 controls the longitudinal movements of the bars 105, 106, the bars being retracted to cause the apparatus to bend concavely downward, and extended to straighten the apparatus. Since the upper side of the apparatus as shown in FIG. 3 is positioned at the inside of the pipe bends, the apparatus need not be bendable in the opposite direction. The cylinder 110 is actuated to extend bars 105, 106 during movement of the apparatus through a pipe, to prevent sag of the central portion of the apparatus.

While a preferred embodiment of the apparatus has been described and shown in the drawings, many modifications thereof may be made by a person skilled in the art without departing from the spirit of the invention, and it is intended to protect by Letters Patent all forms of the invention falling within the scope of the following claims.

I claim:

1. Internal mandrel for supporting the walls of a pipe while the pipe is bent, comprising first plate means having a generally arcuate edge generally conforming to one side of the interior wall of the pipe, second plate means spacedly aligned across the pipe from said first place means having a generally arcuate edge generally conforming to the other side of the interior wall of the pipe, means for moving said first and second plate means between retracted more closely spaced positions relatively farther spaced from the pipe wall and expanded less closely spaced positions relatively closer spaced from the pipe wall comprising body means disposed between the first and second plates of each set thereof, plural knuckle member means pivotally connected between said body means and each of said first and second plate means and each having oppositely facing load bearing surfaces bearing against said body means and one of said first and second plates, and drive means for moving said body means parallely of said first and second plate means to change the angles of said knuckle member means to force said first and second plate means apart against the walls of a pipe, whereby said mandrel may be moved through the pipe to the location of a bend with said first and second plate means in said retracted positions and said first and second plate means may be moved to said expanded positions to support the pipe walls while the pipe is bent.

2. The combination of claim 1, said first and second plate means each having means at their said generally arcuate edges for contacting the interior walls of the pipe.

3. The combination of claim 1, said first and second plate means each comprising an equal plurality of transversely spaced generally parallel plates, and means connecting the plates of each plurality together, whereby a length of the wall of the pipe may be supported by said mandrel.

4. The combination of claim 3, said plate connection means allowing said plates to move to non-parallel positions whereby said mandrel may be bent to move through a curved pipe.

5. The combination of claim 3, said body means comprising connection plate means disposed parallel to said first and second plate means and movable parallely therewith.

6. The combination of claim 3, said drive means comprising hydraulic cylinder means.

7. The combination of claim 3, said body means comprising a pair of connection bodies each movable transversely on the space between said first and second plate means and which are moved reciprocably in opposite directions by said drive means.

8. The combination of claim 7, said drive means comprising hydraulic cylinder means.

9. The combination of claim 8, said hydraulic cylinder means for all sets of first and second plates being operated simultaneously.

10. The combination of claim 9, including means for retaining all of said sets of first and second plate means in alignment during said movements between said retracted and expanded positions.

11. The combination of claim 10, said retaining means for each said set of first and second plate means comprising slot means in said first and second plate means of at least one of said sets transverse to the direction of movement of said connection body means, slide means disposed for non-rotative reciprocal sliding movements in each said slot means, and bar means pivotally connected between each said slide means and each of said connection body means.

12. The combination of claim 3, said means connecting said pluralities of first and second plates together comprising first longitudinal means connected between the terminal plates of said plurality of first plates and second longitudinal means depending between adjacent plates of said plurality of second plates to maintain constant spacing therebetween at the locations of said second longitudinal means, and means for extending and reducing the length of said first longitudinal means to change the spacings of said plurality of first plates to cause said mandrel to bend.

13. The combination of claim 12, said first longitudinal means being slidably disposed through openings through all except said terminal plates of said plurality of first plates.

14. The combination of claim 12, said means for extending and reducing the length of said first longitudinal means comprising a hydraulic cylinder.

15. The combination of claim 12, including wheel means for supporting said mandrel for movement through a length of pipe.

16. The combination of claim 15, said mandrel including retractable drive wheel means for moving said mandrel through a length of pipe.

17. The combination of claim 4, said body means comprising connection plate means disposed parallel to said first and second plate means and movable parallely therewith.

18. The combination of claim 4, said drive means comprising hydraulic cylinder means.

19. The combination of claim 4, said body means comprising a pair of connection bodies each movable transversely of the space between said first and second plate means and which are moved reciprocably in opposite directions by said drive means.

20. The combination of claim 19, said drive means comprising hydraulic cylinder means.

21. The combination of claim 20, said hydraulic cylinder means for all sets of first and second plates being operated simultaneously.

22. The combination of claim 21, including means for retaining all of said sets of first and second plate means in alignment during said movements between said retracted and expanded positions.

23. The combination of claim 22, said retaining means for each said set of first and second plate means comprising slot means in said first and second plate means of at least one of said sets transverse to the direction of movement of said connection body means, slide means disposed for non-rotative reciprocal sliding movements in each said slot means, and bar means pivotally connected between each said slide means and each of said connection body means.

24. The combination of claim 4, said means connecting said pluralities of first and second plates together comprising first longitudinal means connected between the terminal plates of said plurality of first plates and second longitudinal means depending between adjacent plates of said plurality of second plates to maintain constant spacing therebetween at the locations of said second longitudinal means, and means for extending and reducing the length of said first longitudinal means to change the spacings of said plurality of first plates to cause said mandrel to bend.

25. The combination of claim 24, said first longitudinal means being slidably disposed through openings through all except said terminal plates of said plurality of first plates.

26. The combination of claim 24, said means for extending and reducing the length of said first longitudinal means comprising a hydraulic cylinder.

27. The combination of claim 24, including wheel means for supporting said mandrel for movement through a length of pipe.

28. The combination of claim 27, said mandrel including retractable drive wheel means for moving said mandrel through a length of pipe.

29. Internal mandrel for supporting the walls of a pipe while the pipe is bent, comprising first plate means having a generally arcuate edge generally conforming to one side of the interior wall of the pipe, second plate means spacedly aligned across the pipe from said first place means having a generally arcuate edge generally conforming to the other side of the interior wall of the pipe, means for moving said first and second plate means between retracted more closely spaced positions relatively farther spaced from the pipe wall and expanded less closely spaced positions relatively closer spaced from the pipe wall comprising body means disposed between the first and second plates of each set thereof, plural knuckle member means pivotally connected between said body means and each of said first and second plate means, said knuckle members connected to each of said first and second plates being disposed in diametrically opposed positions with respect to the pipe axis, and drive means for moving said body means parallely of said first and second plate means to change the angles of said knuckle member means to force said first and second plate means apart against the walls of a pipe, whereby said mandrel may be moved through the pipe to the location of a bend with said first and second plate means in said retracted positions and said first and second plate means may be moved to said expanded positions to support the pipe walls while the pipe is bent.

30. Internal mandrel for supporting the walls of a pipe while the pipe is bent, comprising first plate means having a generally arcuate edge generally conforming to one side of the interior wall of the pipe, second plate means spacedly aligned across the pipe from said first place means having a generally arcuate edge generally conforming to the other side of the interior wall of the pipe, means for moving said first and second plate means between retracted more closely spaced positions relatively farther spaced from the pipe wall and expanded less closely spaced positions relatively closer spaced from the pipe wall comprising body means disposed between the first and second plates of each set thereof, plural knuckle member means pivotally connected between said body means and each of said first and second plate means and each having oppositely facing load bearing surfaces bearing against said body means and one of said first and second plates, said knuckle members connected to each of said first and second plates in opposed positions with respect to the pipe axis, and drive means for moving said body means parallely of said first and second plate means to change the angles of said knuckle member means to force said first and second plate means apart against the walls of a pipe, whereby said mandrel may be moved through the pipe to the location of a bend with said first and second plate means in said retracted positions and said first and second plate means may be moved to said expanded positions to support the pipe walls while the pipe is bent.

* * * * *